US005113771A

United States Patent [19]

Rini et al.

[11] Patent Number: 5,113,771

[45] Date of Patent: May 19, 1992

[54] PULVERIZED COAL FUEL INJECTOR

[75] Inventors: Michael J. Rini, Hebron; David P. Towle, Windsor, both of Conn.

[73] Assignee: The United States of America as represented by the United States Department of Energy, Washington, D.C.

[21] Appl. No.: 744,752

[22] Filed: Aug. 14, 1991

[51] Int. Cl.[5] ..... F23D 1/00

[52] U.S. Cl. ..... 110/263; 110/264; 110/347

[58] Field of Search ..... 110/263, 264, 265, 347; 431/183, 284, 285; 239/548

[56] References Cited

U.S. PATENT DOCUMENTS 4,223,615 9/1980 Breen et al. ..... 110/264
4,458,607 7/1984 Schoeber et al. ..... 110/347
4,479,442 10/1984 Itse et al. ..... 110/264 X
4,611,543 9/1986 Collette ..... 110/263
4,644,878 2/1987 Nodd et al. ..... 110/264
4,776,289 10/1988 Peter-Hoblyn et al. ..... 110/347
4,796,547 1/1989 Kobayashi et al. ..... 110/263

*Primary Examiner*—Edward G. Favors
*Attorney, Agent, or Firm*—Mark P. Dvorscak; Robert J. Fisher; William R. Moser

[57] ABSTRACT

A pulverized coal fuel injector contains an acceleration section to improve the uniformity of a coal-air mixture to be burned. An integral splitter is provided which divides the coal-air mixture into a number separate streams or jets, and a center body directs the streams at a controlled angle into the primary zone of a burner. The injector provides for flame shaping and the control of $NO/NO_2$ formation.

9 Claims, 5 Drawing Sheets

PULVERIZED COAL FUEL INJECTOR

CONTRACTUAL ORIGIN OF THE INVENTION

The United States Government has rights in this invention pursuant to Contract No. DE-AC22-86PC90275 between the U. S. Department of Energy and Combustion Engineering.

BACKGROUND OF THE INVENTION

This invention relates generally to the use of dense phase pulverized coal, and more particularly to a pulverized coal fuel injector.

Since the oil embargo of 1974, there has been a major effort to develop energy systems that are not dependent on petroleum-based fuels. This effort is expected to be expanded as a result of the political unrest in the Mideast oil producing countries. There are a number of programs which are directed toward increasing both coal usage in existing markets, and by introducing new premium quality coal-based fuels to markets currently dependent on oil or natural gas. In the American industrial sector, a significant portion of the total boiler capacity in operation in the year 2000 is expected to be composed largely of pre-1980 units. Any substantial near term increase in the use of coal for raising industrial steam will therefore have to be accomplished through conversion of existing boilers currently filled by natural gas or oil.

The application of coal or coal-based fuels to industrial boilers originally designed for gas or oil firing presents several technical challenges to the combustion engineer. Constraints such as carbon conversion efficiency, emissions control, and coal and ash handling must be addressed and resolved. In realizing the conversion of existing oil or gas fired burners, significant effort has been made in the past decade in the fields of coal beneficiation, coal-based alternate fuels, and advanced combustion.

By definition, burners introduce and mix the fuel and combustion air in a boiler or process heater to obtain a stable flame. A key function of most burner designs is to manipulate the inflowing combustion air and fuel streams in such a way as to promote rapid fuel ignition by providing the correct chemical, thermal, and kinetic environment to support combustion of the incoming fuel. Flame stability is normally enhanced by creating static air pressure gradients downstream of the burner exit which intensify fuel/air mixing and promote a small volume of combustion products to recirculate back towards the burner. This recirculating mass entrains a portion of the combusting air stream, the luminous flame front is then stabilized when the burner flame propagation speed matches the combustion air flow regime. Also, burner operation is simplified by stable flames which are insensitive to small random fluctuations in stoichiometric ratio and fuel composition.

Using finely ground cleaned coal allows a combustion process resulting in a clean stream of hot gas. However, while combustion of fine cleaned coal reduces ash, the combustion process can be difficult to control. Combustion must occur in a manner which insures good control of the temperature and the local and overall stoichiometric ratio (the ratio of air to fuel in the mixture) to insure complete combustion, and to avoid formation of nitrogen oxide ($NO_x$) pollutants. A fuel injector has been developed which is based on the concept of controlling $NO_x$ by maximizing the devolatilization of nitrogenous species in a substoichiometric environment.

The means for injecting the coal fuel into the combustor has an effect on the production of the pollutant $NO_x$, and several types are well known in the art. For example, U.S. Pat. No. 4,654,001 discloses a burner nozzle for pulverized coal in which mixing members mix fuel passing around and through outer and inner tubular members. The fuel is further divided into an outer fuel-rich stream and an inner fuel-lean stream. The coal-rich stream is ejected as a circular stream, while the air in the inner fuel-lean stream is not available for combustion in the initial combustion region adjacent the burner nozzle.

U.S. Pat. No. 4,497,263 is a burner which receives a stream of coal and air and forms two mixtures: one containing most of the coal and the other containing most of the air. A convergent-divergent discharge tube discharges the fuel, and swirler blades cause the coal and air to intermix and recirculate, resulting in a rich mixture.

U.S. Pat. No. 4,457,241 discloses a low $NO_x$ burner nozzle in which a tubular nozzle has a divergent flow section and a convergent flow section. A flow spreader which is positioned adjacent the outlet end of the nozzle discharges the fuel in an annularly shaped, swirling flow pattern.

Accordingly, it is an object of the present invention to control the formation of $NO_x$ by maximizing the devolatilization of nitrogenous species in a substoichiometric environment through the use of a novel coal injector.

It is a further object of the present invention to promote the production of environmentally benign $N_2$ rather than $NO_x$ pollutants.

Still a further object of the present invention is to provide an improved and uniform distribution of the fuel within the primary burn zone of a coal combustor and to enhance the effect of improved flame attachment and flame stability.

Yet another object of the present invention is to provide a concentrated and focused fuel rich core to take maximum advantage of the substoichiometric devolatilization principle thus supplementing $NO_x$ reduction.

SUMMARY OF THE INVENTION

This invention provides a pulverized coal injector which comprises a coal combustor including a burner tube having a central axis, an upstream end, a downstream end, and a primary burn zone adjacent of the combustor, and further wherein the tube is capable of carrying a stream of a pulverized coal-air mixture to be burned. The injector further includes an acceleration means located in the tube for improving the uniformity of the coal-air mixture, which is defined as a convergence of the burner tube upstream from the center body portion. Additionally, a means is connected to the downstream end of the tube for injecting the coal-air mixture into the primary burn zone of the combustor. The injecting means includes a plurality of means for splitting the stream of the coal-air mixture into a plurality of separate streams. The splitting means is capable of providing that the separate streams impinge upon each other upon being discharged into the primary burn zone of the combustor.

The injecting means is preferably a nozzle and receives the coal-air mixture from the burner tube, and then discharges the coal-air mixture into the primary burn zone of the combustor. The nozzle is coupled between the burner tube and the primary burn zone of the combustor. It includes a plurality of passages for splitting the stream of the coal-air mixture into a corresponding plurality of separate streams. The passages are inclined and converge with respect to the central axis of the burner tube such that the plurality of separate streams impinge upon each other upon being discharged into the primary burn zone of the combustor.

A center body is located at the downstream end of the burner tube which is disposed to direct the separate streams at a controlled angle relative to the central axis of the burner toward the plurality of passages. Preferably, the center body is a conoid connected to a frustroconical solid.

The nozzle also includes an inlet side and an outlet side, and each of said passages includes an entry portion at the inlet side for receiving the separate streams, and a discharge portion at the outlet side for discharging the separate streams. The discharge portion of the passages is inclined with respect to the central axis of the burner. The nozzle can include eight passages for dividing the coal-air mixture into eight separate streams. If eight passages are provided, they are preferably inclined at about an angle of seven and one-half degrees with respect to the central axis of the burner, and the separate streams of the coal-air mixture impinge upon each other eight inches downstream from the outlet side of the nozzle.

BRIEF DESCRIPTION OF THE DRAWINGS

The above-mentioned and other features of the invention will become more apparent be best understood, together with the description, by reference to the accompanying drawings, in which.

DETAILED DESCRIPTION OF THE INVENTION

Figure 1:
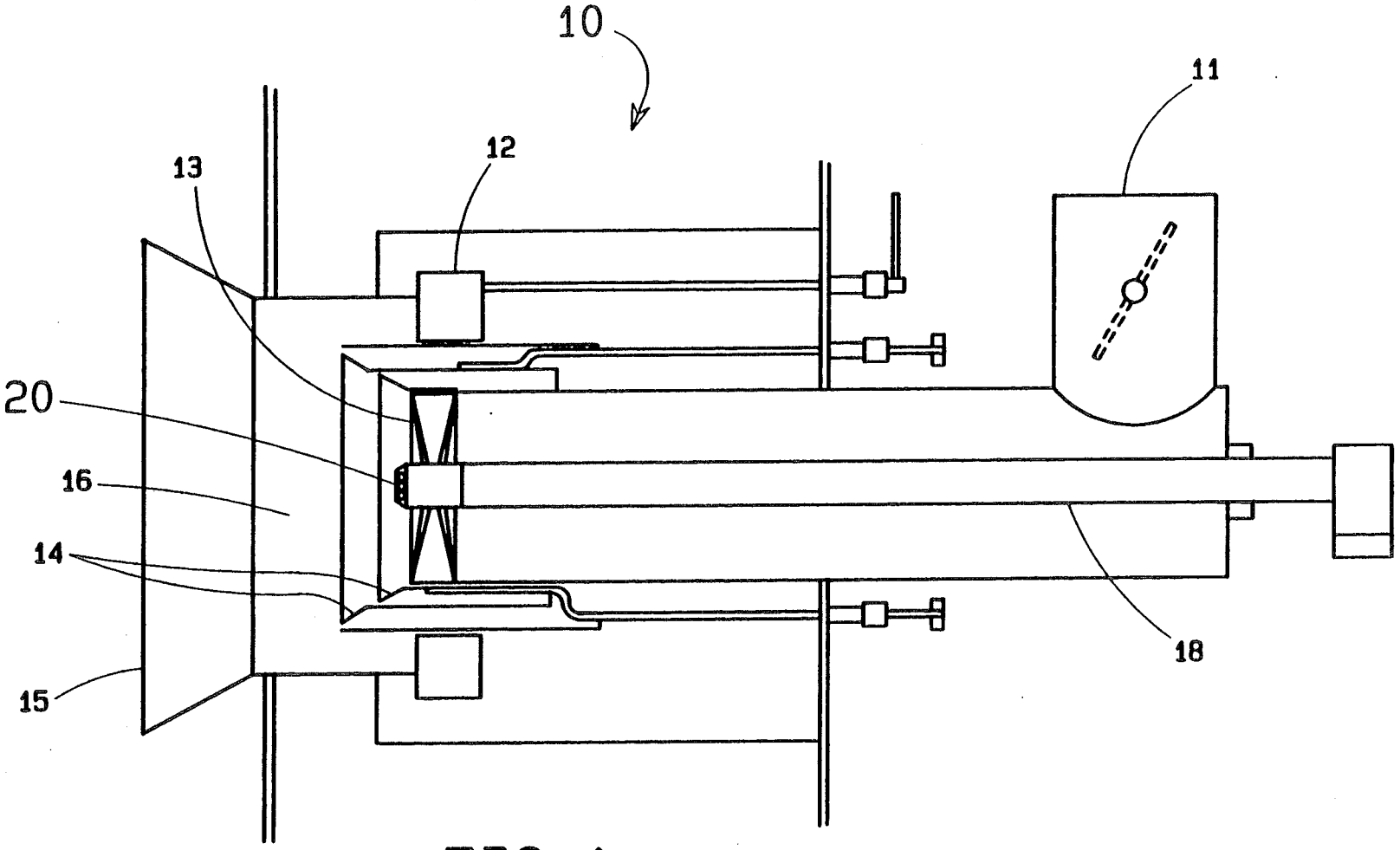
FIG. 1 shows a coal combustor burner with impinging fuel injector nozzle.

Referring to FIG. 1, there is shown a coal combustor burner 10 having a pulverized coal fuel injector or nozzle 20 in accordance with the present invention. The burner 10 facilitates boiler retrofit applications and incorporates technologies designed to control gaseous pollutant emissions of $NO_x$ and $SO_2$. It is a firing system for coal-based fuels that enables the replacement of oil and natural gas in boilers and other fuel firing equipment currently using these premium fuels. The burner 10 includes: a primary air damper 11, an adjustable tertiary air swirler 12, a high efficiency primary air swirler 13, distributed secondary air swirler 14, and a non-refractory quarl 15. A primary burn zone is located at a downstream location 16.

The burner lo also includes a burner tube 18 with discharge nozzle 20. This tube is an elongated hollow tube in which a stream of pulverized coal-air mixture to be burned is carried. It is contemplated that the coal can be conveyed to the burner in dense phase. on the order of about thirteen pounds of fuel to one pound of air (known as dense phase transport), although it is adaptable over the range of coal to primary (transport) air ratios of 100 lbs coal to 1 lb air to 0.2 lbs coal to 1.0 lb air.

Figure 2:
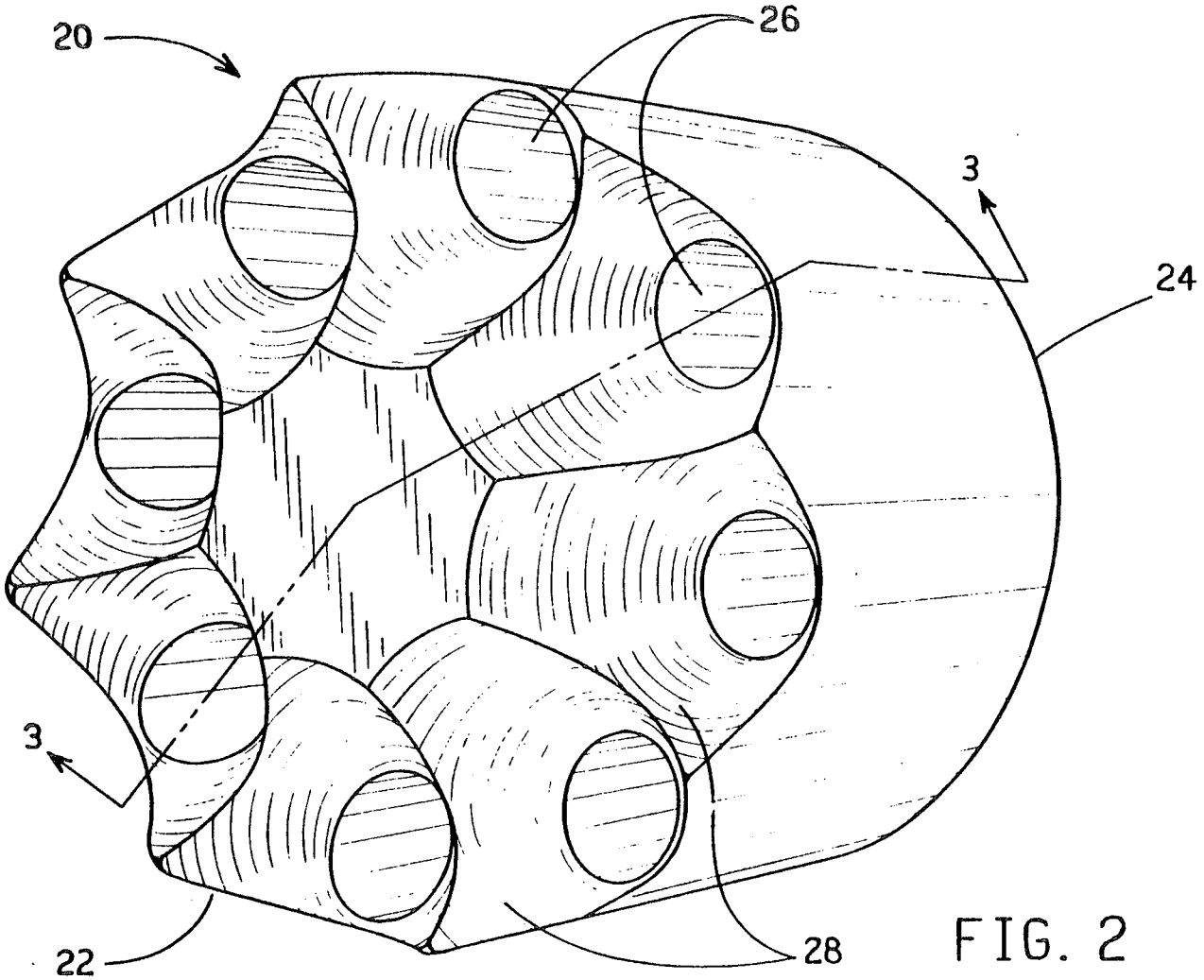
FIG. 2 shows a perspective view of the inlet side of the impinging jet discharge nozzle.

Referring now to FIG. 2, there is shown a perspective view of a discharge nozzle means 20 for injecting the coal-air mixture into the primary zone of the burner. The injecting means includes a plurality of means 26 for splitting the stream of the coal-air mixture into a corresponding plurality of separate streams or jets. The splitting means are capable of providing that the separate streams of the coal-air mixture impinge upon each other upon being discharged into the primary burn zone of the combustor. Preferably, the injecting means 20 is a pulverized coal injector or nozzle that is connected to the downstream end of the burner tube. The nozzle 20 is a cylindrical body and has an inlet side 22 and an outlet side 24. It is preferably made from carbon steel, stainless steel, or a castable, wear-resistant material such as refractory material. The splitting means 26 are disposed through the nozzle and can be a plurality of bores or passageways which are circumferentially arranged about the axis of the nozzle. The bores 26 split the stream of the coal-air mixture into a corresponding plurality of separate streams. The nozzle receives the coal-air mixture from the burner tube 18, and then divides the mixture into a number of separate streams.

Figure 3:
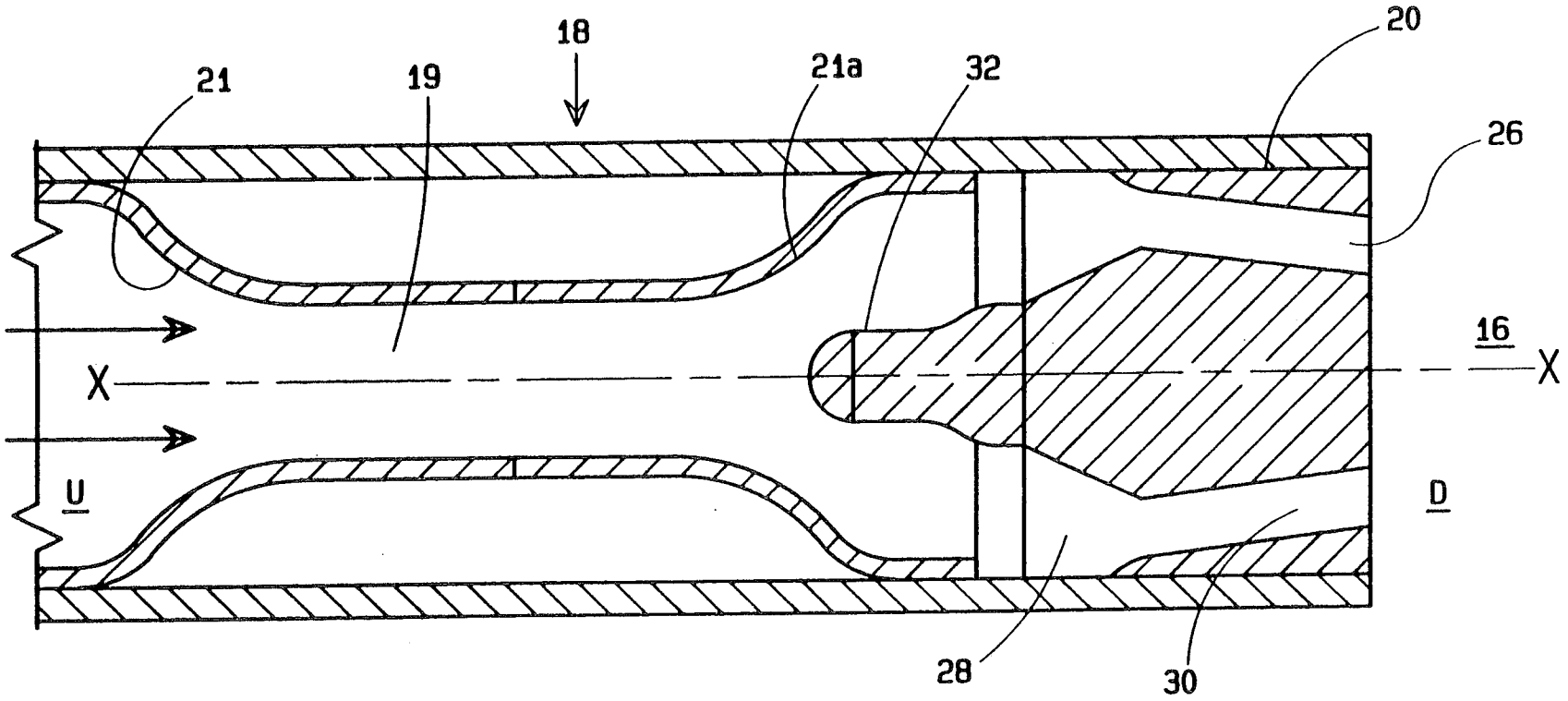
FIG. 3 shows a sectional view along the line 3—3 of FIG. 2 of the discharge nozzle connected to the burner tube of the combustor.

A cross sectional view of the nozzle 20 coupled to the burner tube is shown in FIG. 3. Arrows indicate the direction of pulverized coal flow. The tube 18 has a central axis X—X, and an upstream end U and a downstream end D. A primary burn zone 16 is adjacent to the downstream end. An internal burner tube 21 converges or narrows and forms an acceleration section 19 which improves the uniformity of the coal-air mixture. The tube 21 becomes broader at its downstream end 21*a*, approximating the shape of a bell. This allows the coal-air mixture to diverge. As illustrated, it is seen that the bores 26 of the nozzle are inclined toward and with respect to the central axis X—X of the combustor tube 18. Each bore is funneled such that an entry portion 28 and a discharge portion 30 is formed. The entry portion 28 of each bore is located at the inlet side of the nozzle and is a small, tapered transition, formed by boring a plurality of holes around the circumference of the nozzle, the holes having an axis parallel to the axis X—X. The entry portion 28 has several functions: it reduces energy losses; it assists in providing a smooth flow of the pulverized coal; and assists in the transition from one shape to the other.

The discharge portion 30 of each bore is connected to the entry portion, extends to the outlet side of the nozzle, and is defined as a passageway which converges with respect to the central axis X—X. The hole of the entry portion 28 has a larger diameter than the hole of the discharge portion. Merely by way of example, one embodiment of the invention as illustrated in FIGS. 2 and 3 shows a nozzle with eight bores, the inclination of the discharge portion 30 is about 7½ toward and relative to the axis X—X. The nozzle can have any number of passages in the range of from two to twenty. The plurality of separate streams in the nozzle are discharged from the nozzle at the outlet side and impinge upon each other at some downstream location. Preferably, the downstream location is the primary burn zone 16 of the combustor, which would be about eight inches from the outlet side of the nozzle, but can range up to about three (3) feet. Causing the separate streams to impinge upon each other at this location provides for flame shaping and controls the formation of $NO_x$ pollutants, and promotes the production of environmentally benign $N_2$. The impinging streams reduce the entrainment of locally available combustion air, thereby enhancing the $NO_x$ reduction effects.

Also shown in FIG. 3 is a rounded, flow shaping center body 32 located at the downstream end of the burner tube along its axis, and attached to the nozzle 20 at the inlet side. The center body 32 can be a conoid connected to a frustro-conical solid, and in this embodiment, it directs the separate streams of the coal-air mixture at a controlled angle (about $+30°$ to $-10°$) relative to the central axis X—X of the burner, into the primary zone of the burner.

Figure 4:
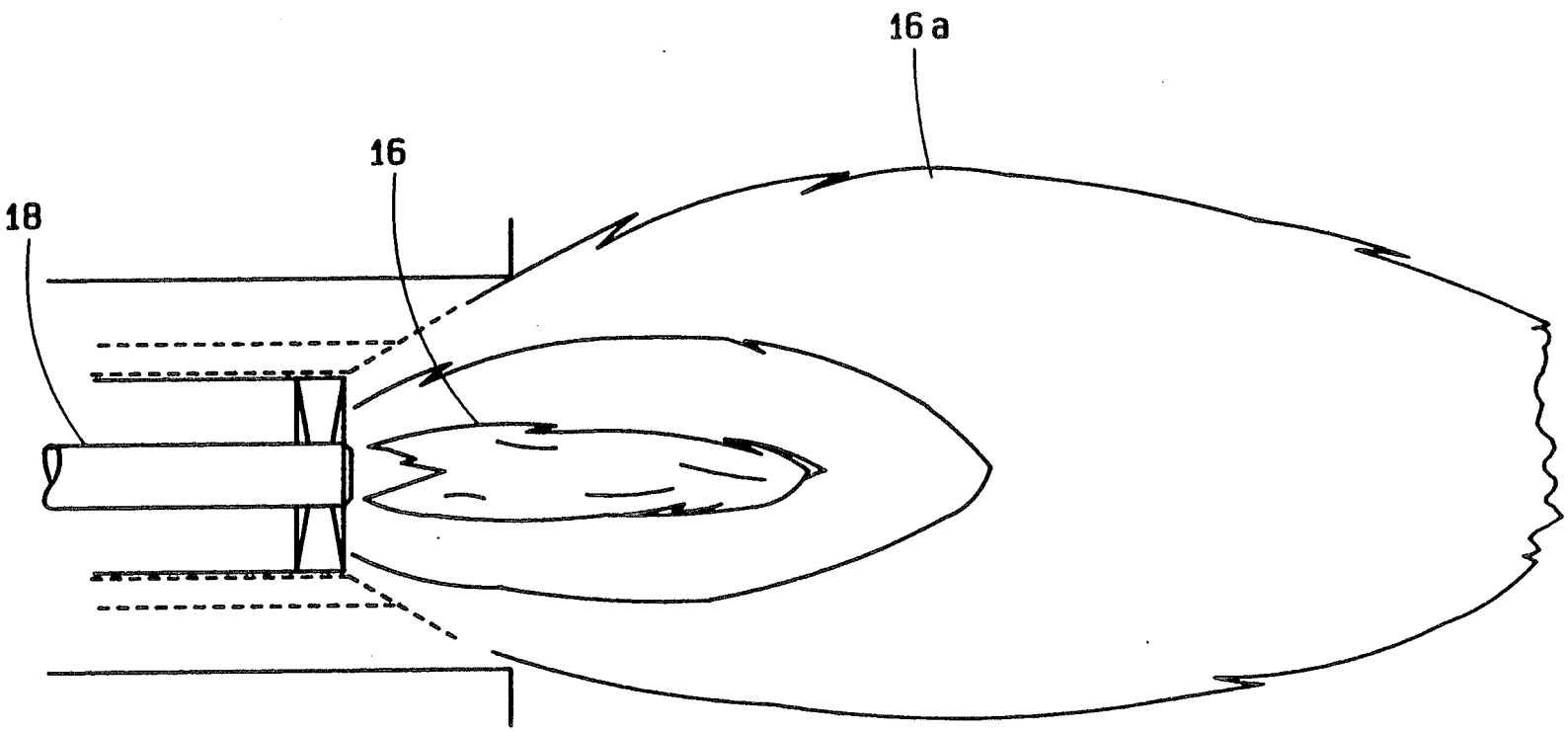
FIG. 4 shows the downstream end of the impinging jet discharge nozzle installed in the combustor with the impinging fuel jet in the primary burn zone; and, FIG. 5 shows a graphical comparison of $NO_x$ as a Function of Excess Air Level vs Fuel Injector Type.
Figure 5:
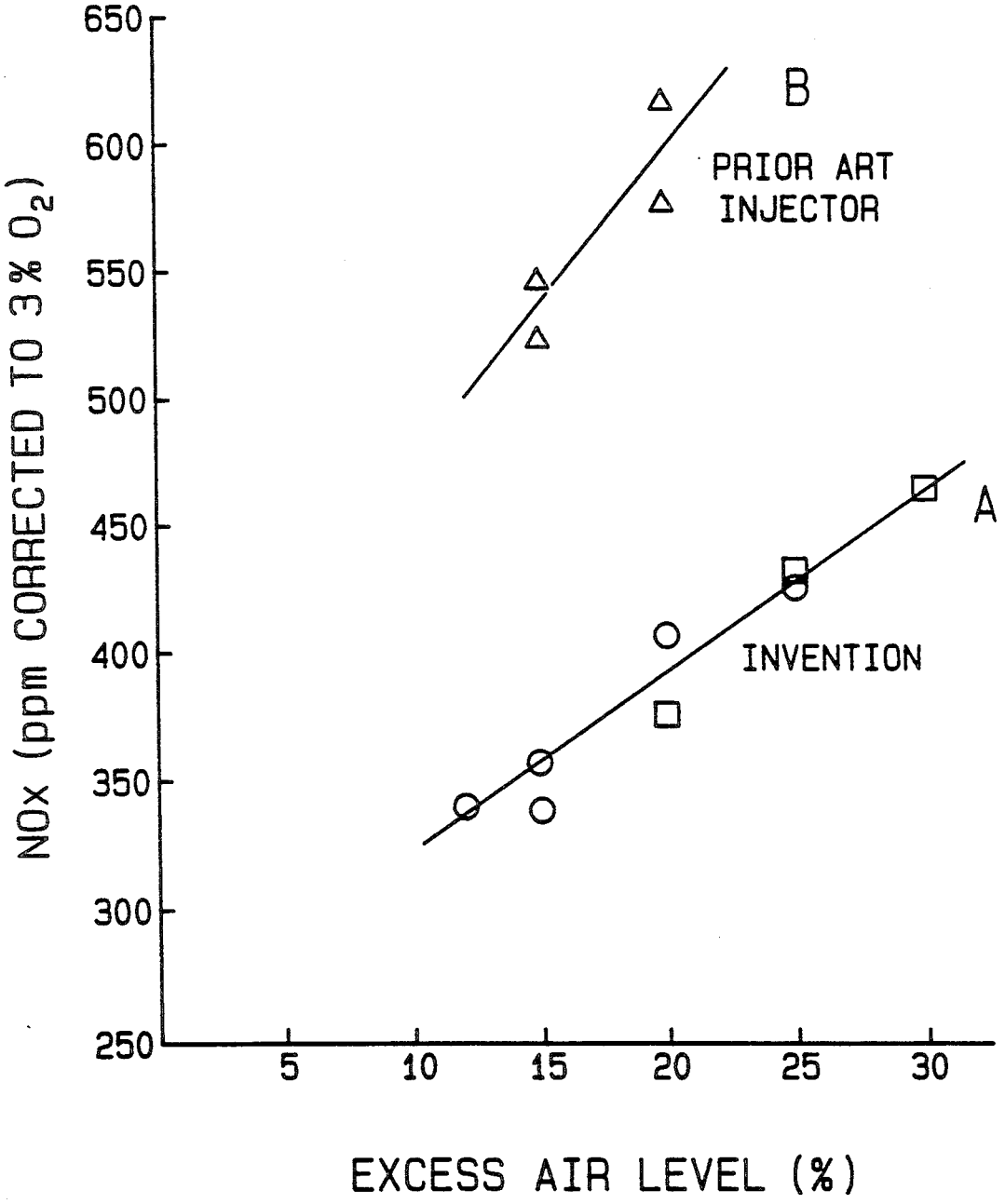

FIG. 4 illustrates the discharge pattern of the impinging separate streams into the primary burn zone 16 of the burner. Also illustrated is secondary zone 16*a*. The disclosed fuel injector controls $NO_x$ by maximizing the devolatilization of nitrogenous species in a substoichiometric environment. This promotes the production of environmentally benign $N_2$ rather than $NO_x$ pollutants. The passageways in the nozzle provide a uniform distribution of the fuel within the primary burn zone 16, and also improves flame attachment. The angle of inclination of the discharge portion of the bores of about $7\frac{1}{2}°$, which causes the separate streams to intersect eight inches downstream of the nozzle outlet, provides a concentrated and focused fuel rich core to take maximum advantage of substoichiometric devolatilization principle. This also supplements $NO_x$ reduction. Referring to FIG. 5, a graphical comparison of $NO_x$ as a function of excess air level and fuel injector type is shown. The injector of the present invention is represented by curve A, and the data resulting from the use of a prior art injector having a converging-diverging section in which the coal is discharged divergently, is represented by curve B. U.S. Pat. No. 4,654,001, issued Mar. 31, 1987 to LaRue, is representative of a converging-diverging injector. It is seen that the injector of the present invention produces less $NO_x$ than that produced by the prior art injector.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described to best explain the principles of the invention and its practical application and thereby enable others skilled in the art to best utilize the invention in various embodiments and with various modifications as are suited to the particular use contemplated. It is intended that the scope of the invention be defined by the claims appended hereto.

The embodiments of the invention in which exclusive property rights or privileges are claimed are defined as follows:

1. A pulverized coal injector for a coal combustor comprising:

a) a burner tube having a central axis, an upstream end, a downstream end, and a primary burn zone adjacent to the downstream end, and further wherein said tube is capable of carrying a stream of a pulverized coal-air mixture to be burned, b) an acceleration means located in the tube for improving the uniformity of the coal-air mixture;

c) a converging means connected to the downstream end of the tube for injecting the coal-air mixture into the primary burn zone of the combustor, said converging means including means for splitting the stream of the coal-air mixture into a plurality of separate streams;

d) and further wherein said splitting means directs the separate streams to impinge upon each other upon discharge into the primary burn zone of the combustor.

2. The coal injector of claim 1 wherein the converging means is a nozzle coupled between the burner tube and the primary burn zone of the combustor, and wherein the nozzle includes a plurality of passages for splitting the stream of the coal-air mixture into a corresponding plurality of separate streams.

3. The coal injector of claim 2 wherein the passages converge toward the central axis of the burner tube such that the plurality of separate streams impinge upon each other upon being discharged into the primary burn zone of the combustor.

4. The coal injector of claim 3 further including an axially disposed, rounded body located at the downstream end of the burner tube, said body disposed to direct the coal-air mixture at a controlled angle relative to the central axis of the burner toward the plurality of passages.

5. The coal injector of claim 4 wherein the acceleration means is defined as a convergence of the burner tube upstream from the center body portion.

6. The coal injector of claim 5 wherein the nozzle includes an inlet side and an outlet side, and each of said passages includes an entry portion at the inlet side for receiving the separate streams, and a discharge portion at the outlet side for discharging the separate streams, and wherein the discharge portion of the passages is inclined toward the central axis of the burner.

7. The coal injector of claim 6 wherein the nozzle includes eight passages for dividing the coal-air mixture into eight separate streams.

8. The coal injector of claim 7 wherein the passages of the nozzle are inclined at an angle of about seven and one-half degrees with respect to the central axis of the burner.

9. The coal injector of claim 8 wherein the separate streams of coal-air mixture impinge upon each other about eight inches downstream from the outlet side of the nozzle.

* * * * *